US005613773A

United States Patent [19]

Scott et al.

[11] Patent Number: 5,613,773

[45] Date of Patent: Mar. 25, 1997

[54] APPARATUS AND METHOD FOR GENERATING FOAM FROM PRESSURIZED LIQUID

[75] Inventors: Blayney J. Scott, Victoria; Barry G. Gilbert, Sidney; George R. Cowan, Burnstown, all of Canada

[73] Assignee: Scott Plastics Ltd., Victoria, Canada

[21] Appl. No.: 458,260

[22] Filed: Jun. 2, 1995

Related U.S. Application Data

[62] Division of Ser. No. 55,882, May 4, 1993, Pat. No. 5,445, 226.

[51] Int. Cl.[6] ..... B01F 15/02; B01F 13/02

[52] U.S. Cl. ..... 366/163.2; 169/44; 366/101

[58] Field of Search ..... 366/163.1, 163.2, 366/101, 106, 107; 169/44, 15; 137/889, 890, 599.1

[56] References Cited

U.S. PATENT DOCUMENTS

| | | | |
|---|---|---|---|
| 615,213 | 11/1898 | Deming . | |
| 644,237 | 12/1900 | Deming . | |
| 862,867 | 8/1907 | Eggleston . | |
| 2,513,417 | 2/1946 | Lindsay | 261/116 |
| 3,234,962 | 2/1966 | Williamson | 137/565 |
| 3,701,482 | 10/1972 | Sachnik | 239/590.3 |
| 3,856,270 | 12/1974 | Hemker | 259/4 |
| 4,123,800 | 10/1978 | Mazzei | 366/163.2 |
| 4,147,478 | 4/1979 | Vork | 417/458 |
| 4,361,407 | 11/1982 | Pellegrini | 366/340 |
| 4,478,516 | 10/1984 | Kessler | 366/87 |
| 4,645,009 | 2/1987 | Hawelka et al. | 169/15 |
| 4,688,643 | 8/1987 | Carter et al. | 169/33 |
| 4,781,467 | 11/1988 | Williams | 366/163.1 |
| 4,805,700 | 2/1989 | Hoover | 169/15 |
| 4,830,790 | 5/1989 | Stevenson | 261/18.1 |
| 4,964,733 | 10/1990 | Fredriksson et al. | 366/336 |
| 4,993,495 | 2/1991 | Burchert | 169/14 |
| 5,082,633 | 1/1992 | Stuper | 422/133 |
| 5,137,094 | 8/1992 | Broussard | 169/15 |
| 5,171,090 | 12/1992 | Wiemers | 366/163.2 |
| 5,388,905 | 2/1995 | Ake | 366/163.2 |

FOREIGN PATENT DOCUMENTS 1266073 of 0000 Canada .

OTHER PUBLICATIONS

Maverick Foam Vest System Brochure Date of publication unknown.

*Primary Examiner*—Robert W. Jenkins
*Attorney, Agent, or Firm*—Bull, Housser & Tupper

[57] ABSTRACT

A foam generating apparatus can be attached to a water bearing hose and comprises an eductor nozzle to receive water and foam concentrate, and a foam generating nozzle to discharge a foam/water mixture therethrough. A foam concentrate conduit delivers concentrate to a manifold extending peripherally around a suction port of the eductor nozzle, and foam concentrate is drawn into the eductor nozzle to mix with water and to be discharged as a foam/water mixture to the foam generating nozzle. The nozzle has an agitator jet orifice for agitating the mixture, and an air entrainment opening to admit air into the agitated mixture. The agitator jet orifice has inlet and outlet jet openings interconnected in series, the outlet jet opening being larger than the inlet jet opening to provide a diverging passage with at least one step between the inlet and outlet jet openings to agitate the flow. The step has an abrupt step edge to enhance agitation and is relatively long when compared with cross-sectional area of the inlet jet opening. The inlet jet and outlet jet openings are non-circular, and preferably elongated slits to provide a long length of step.

19 Claims, 3 Drawing Sheets

APPARATUS AND METHOD FOR GENERATING FOAM FROM PRESSURIZED LIQUID

CROSS REFERENCES TO RELATED APPLICATIONS

This application is a divisional application of application Ser. No. 08/055,882, filed 4 May 1993 and entitled FOAM GENERATING APPARATUS FOR ATTACHMENT TO HOSE DELIVERING PRESSURIZED LIQUID, now U.S. Pat. No. 5,445,226.

BACKGROUND OF THE INVENTION

The invention relates to an apparatus which can be attached to a pressurized water bearing hose to generate foam, in particular to an apparatus for attachment to a fire fighting hose to generate fire fighting foam from a supply of pressurized water as used in fire fighting.

While water is used for many fire fighting applications, when the water is mixed with a small amount of foam concentrate or foaming agent and passed through a suitable foaming nozzle, a large volume of foam can be generated. For many common fire fighting applications e.g. Class A fires involving wood, paper etc., foam is considerably more effective than water by itself. Also for special fire fighting situations e.g. Class B fires involving liquid fuels, combustible solvents etc., water by itself cannot be used, and thus foam, dry powder or gaseous extinguishers must be used. Foam is usually necessary for large Class B fires, as the other methods are too costly or not practical.

Foam can be applied on a fire from two sources, namely from a pressurized canister source, or by adding foam concentrate to a stream of water under pressure. The first source of foam applying equipment is limited for use on small fires only, due to its small capacity which is usually limited to the size of canister that can be easily handled by one person. The second source of foam applying equipment is commonly mounted on a fire truck to facilitate transport to a site. The second source of foam applying equipment is described herein and comprises a foam concentrate metering and mixing device for adding to pressurized water from a hydrant or to another pressurized water source. The mixture of pressurized water and foam concentrate must be passed through a suitable nozzle to generate foam, the nozzle also providing a means of mixing air with the water and foam mixture so as to generate a suitable continuous supply of foam. Where water is not pressurized, a water pressurizing device such as a pump is used to raise water pressure, often concurrently with adding a metered amount of foam concentrate to the water stream. The foam concentrate can be introduced to the water stream at the truck itself, in which case the foam concentrate is simultaneously mixed and fed along the hose, and is then discharged at the source of fire. If the foam concentrate is fed along a sufficient length of hose, there is usually no difficulty in mixing the concentrate with the water, so that when the foam water mixture passes through the foaming attachment on the nozzle, a good supply of foam is generated.

One disadvantage with introducing the foam to the hose pipe at the truck is that the hose pipe is then somewhat limited to delivering only foam, and cannot be quickly easily changed to delivering water, at least not by the person directing the hose. Relatively complex machines that resemble the first type of foam generating devices are shown in U.S. Pat. Nos. 4,645,009 (Hawelka et al.) and 3,234,962

(Williamson). Such machines can be relatively costly and this detracts from their use.

Alternatively, the foam concentrate can be fed in a separate concentrate hose extending along the main water hose to an eductor nozzle located at a position in the hose, suitably some distance from the discharge nozzle to permit adequate mixing of the foam concentrate with the water prior to discharge. This method has a disadvantage of having two parallel lengths of hoses for at least a short length of the water hose, with a separate control on the foam concentrate hose to control supply of the foam concentrate. A simple means of metering foam concentrate into a water stream is shown in U. S. Pat. No. 4,993,495 (Burchert) in which water passes through a venturi means and generates suction to draw foam concentrate into the water flow. With this alternative device, there must be sufficient length of hose downstream from the venturi means to provide adequate mixing of the concentrate and foam before the mixtures passes through a nozzle to generate foam. A nozzle to generate foam from a water and foam concentrate mixture is shown in Canadian Patent 1,266,073 (Stevenson). Such a nozzle requires to be supplied with a mixture of water and foam and thus requires at least a foam concentrate metering and mixing structure upstream of the nozzle which structure is usually provided at the fire tank or in the length of the water hose.

An apparatus which combines metering and mixing of foam concentrate essentially integral with a foaming nozzle is shown in U.S. Pat. No. 2,513,417 (Lindsay). This patent shows an eductor nozzle structure for drawing foam concentrate into a stream of water prior to ejecting the resulting mixture through a foaming nozzle which draws in air to generate foam. This is a relatively complex mixing nozzle with an annular gap located downstream of a converging section for drawing foam concentrate into the water, followed by a constant cross-section portion with a conical spreader which separates the stream of mixture in an air entrainment chamber. A further teardrop-shaped baffle is required to control velocity of the fluid to achieve a more uniform foam quality.

SUMMARY OF THE INVENTION

The invention reduces the difficulties and disadvantages of the prior art by providing a relatively simple foaming apparatus which can be easily attached to an end of a water bearing hose. The apparatus permits an accurately metered supply of foam concentrate to be added to water flowing through the hose, and immediately thereafter to be generated into foam within a length of discharge nozzle which is sufficiently short to be easily handled by a single operator. In this way, an operator can easily manoeuvre the foam generating nozzle, e.g. as a fire fighting nozzle, when in confined spaces, and has easy access to initiate or stop the supply of concentrate. If the foaming apparatus is not required, it can be easily removed from the hose. Preferably, the supply of foam concentrate for this apparatus can be carried in a container which can be carried on the back of the person holding the nozzle, preferably adjacent the hips so that the person's back is free of obstruction to permit the person to carry a breathing apparatus if required. In addition, the invention is light-weight, easy to adjust for different capacities and has a relatively low production cost and thus contrasts with some of the prior art apparatus which are costly investments.

One example of a foaming apparatus according to the invention disclosed herein is for attachment to a water bearing hose and comprises an eductor nozzle, delivery manifold means and a foam concentrate conduit. While a specific structure is shown for the eductor nozzle, other eductor nozzles can be substituted to admit foam concentrate into a flow of pressurized water to produce a foam/water mixture. In addition, foam can be admitted into a flow of pressurized water in a conventional fire fighting apparatus, and agitation of the mixture can take place downstream therefrom at an air entrainment nozzle provided with an agitator apparatus according to the invention.

The agitator apparatus according to the invention generates foam from a flow of pressurized water and foam concentrate, and has an agitator body which comprises an agitator jet orifice and a first step means. The agitator jet orifice comprises an inlet jet opening and an outlet jet opening disposed in series, and the first step means is located between the inlet and outlet jet openings. The outlet jet opening is larger than the inlet jet opening and communicates with the inlet jet opening to define a diverging passage extending through the agitator body. Flow through the agitator jet orifice passes across the first step means to agitate the flow to enhance mixing and generation of foam. Preferably, the step means has an abrupt edge to enhance agitation, and the jet orifice is non-circular to provide a relatively long step edge when compared with the cross-sectional area of the inlet jet opening. Preferably, the inlet jet opening is an elongated inlet slit having a width defined by space between oppositely facing inlet slit side walls. Similarly, the outlet let opening is an elongated outlet slit having a width defined by space between outlet slit side walls. The width of the outlet let opening is greater than the width of the inlet jet opening. The inlet and outlet jet openings are aligned about a jet axis to define at least one step located between at least one inlet slit side wall and one outlet slit side wall adjacent one side of the slit.

A method of generating foam from a flow of pressurized water and foam concentrate comprises passing the flow through a relatively small inlet jet opening and across at least one first step edge into a relatively large outlet jet opening communicating therewith to provide a diverging passage, the step edge augmenting agitation of the flow to produce a foamed mixture. Preferably, the method further comprises passing the flow across the step edge which is relatively long when compared with cross-sectional area of the inlet jet opening. Also, the method further comprises passing the flow through the relatively small inlet jet opening defined by at least one pair of laterally spaced apart parallel inlet slit side walls, passing the flow through the relatively large outlet jet opening defined by a pair of parallel outlet slit side walls, and as the flow passes from the inlet jet opening to the outlet jet opening, passing the flow across the step edge which causes portions of the flow to move laterally outwardly across the step edge to agitate the flow.

A detailed disclosure following, related to drawings, describes a preferred apparatus and method according to the invention which are capable of expression in structure and method other than those particularly described and illustrated.

DETAILED DESCRIPTION

FIG. 1

Figure 1:
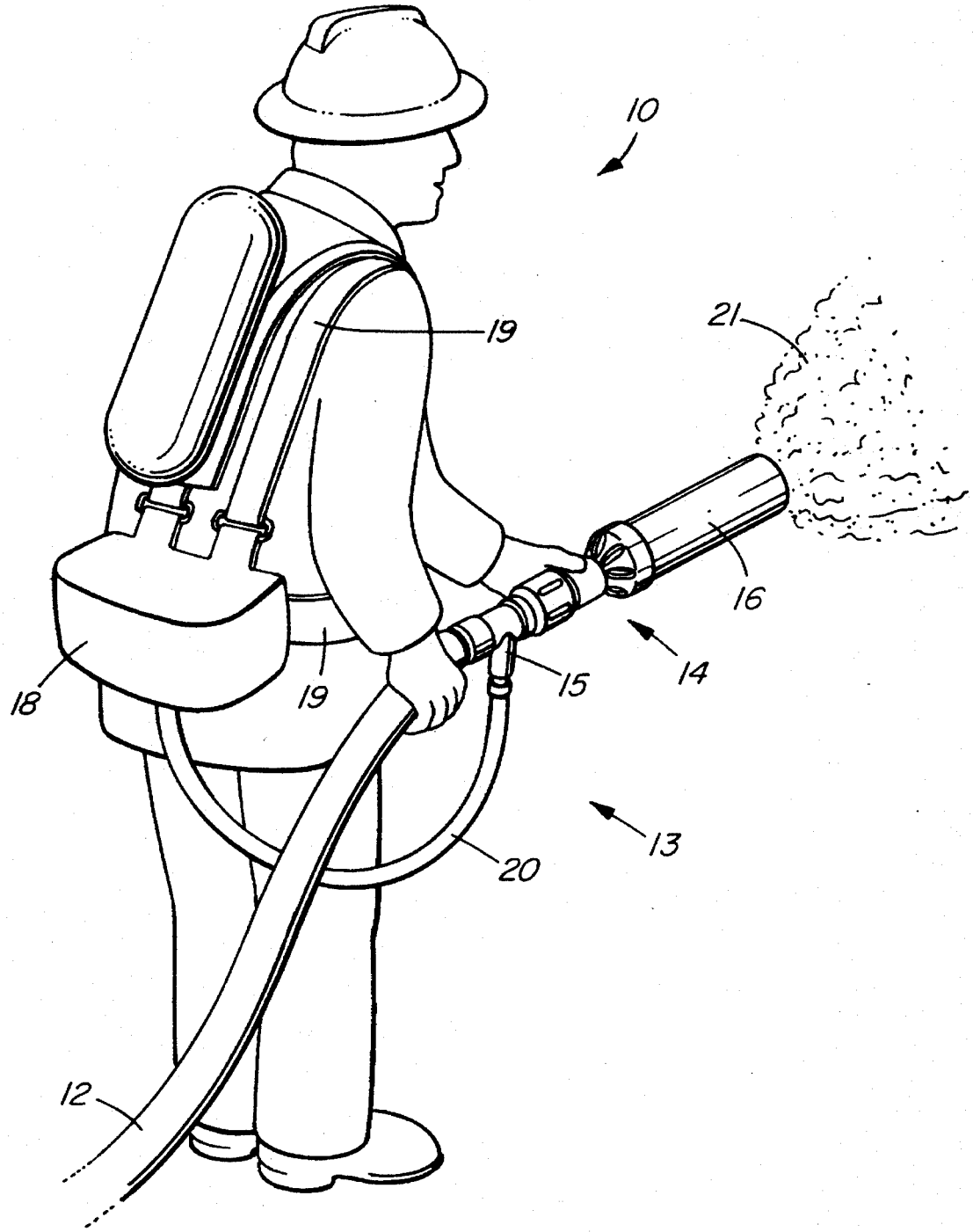
FIG. 1 shows a fire fighter using a foam fire-fighting apparatus according to the invention.

A fire fighter 10 is shown carrying a conventional water bearing fire hose 12 and a fire fighting foaming apparatus 13 according to the invention. The apparatus 13 includes a foaming apparatus 14 according to the invention fitted to an end of the hose 12, the foaming apparatus comprising a mixing body 15 and a foam generating nozzle 16 fitted to the mixing body. The fire fighting apparatus 13 also includes a foam concentrate container 18 for carrying foam concentrate liquid, the container having shoulder and waist straps 19 for passing around the torso of the fire fighter to secure the container adjacent the fire fighter's back. A foam concentrate hose 20 extends from the container 18 to the apparatus 14 to supply foam concentrate thereto which is mixed with water from the hose 12 and ejected from the nozzle 16 as foamed water 21, or fire fighting foam.

As illustrated, the container 18 is mounted in a low position on the torso, generally adjacent the hips, to provide room on the fire fighter's back to carry breathing apparatus or other accessories commonly used by fire fighters. Clearly, if the fire fighter is not required to carry other equipment on the upper portion of the back, an alternative and larger concentrate container could be worn higher on the back, more as a conventional backpack, which would permit carrying more foam concentrate if required. In any event, the container straps are connected thereto to permit the container to be carried on the fire fighter's back. Also, preferably the container is made from a liquid impermeable fabric, which is resistant to chemical action of the foam concentrate, to facilitate carrying on a person's back. As the fabric is relatively flexible, the container can collapse as foam concentrate is withdrawn therefrom, thus eliminating the need for a breather opening. Alternatively, the container could be rigid with a suitable breather or vent to permit removal of foam concentrate from the container.

Figure 2:
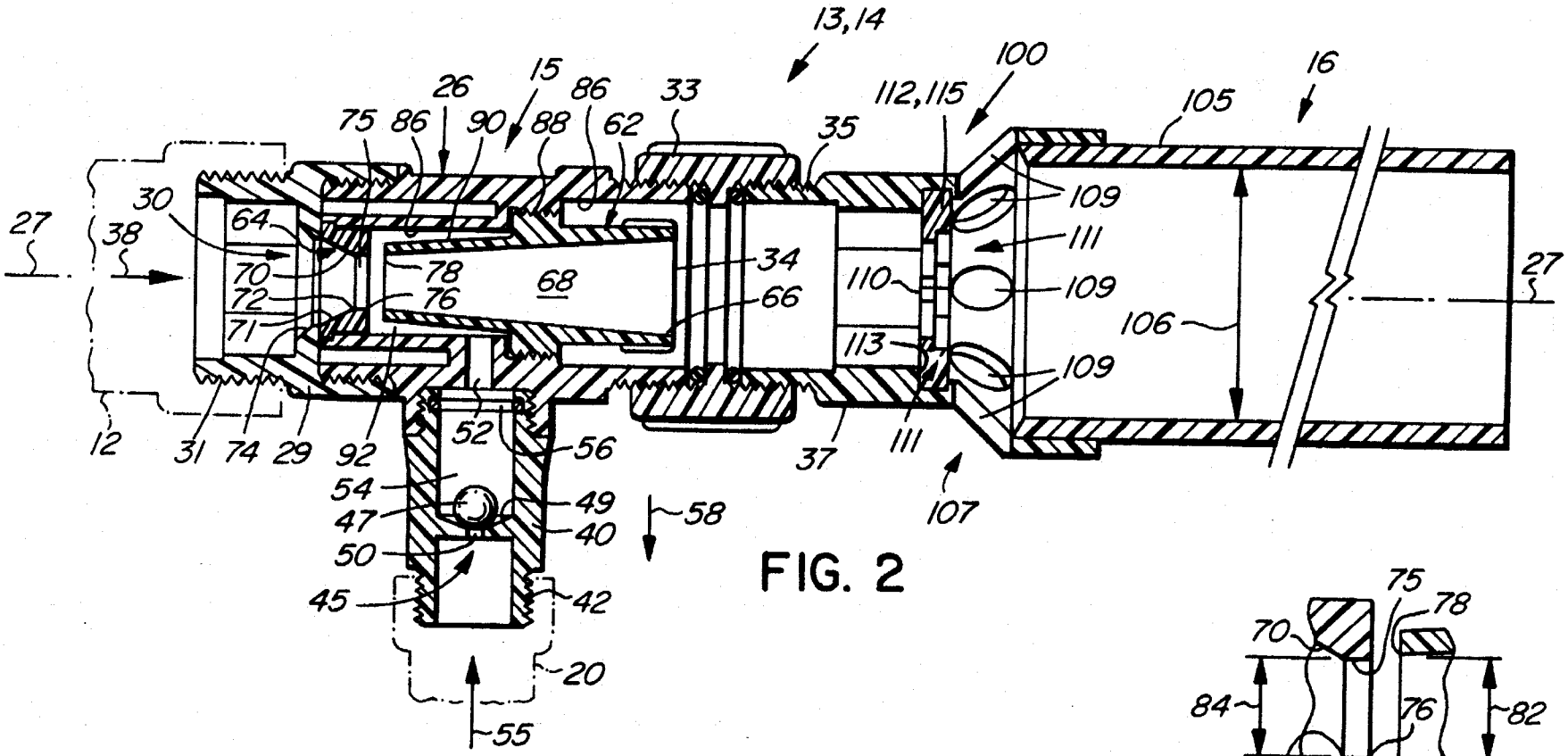
FIG. 2 is a simplified, fragmented, longitudinal section through a portion of the apparatus of FIG. 1.
Figure 2A:
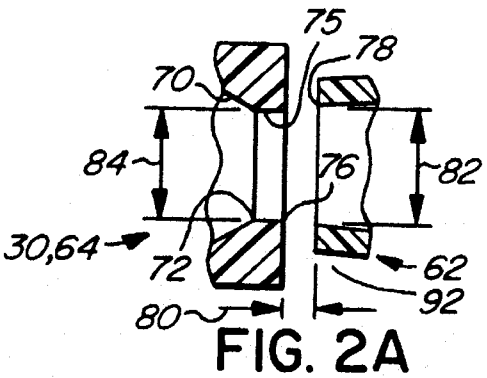
FIG. 2A is a fragmented enlarged detail of a portion of FIG. 2.

FIGS. 2 and 2A

The mixing body 15 is generally T-shaped and has a main tubular portion 26 disposed along a longitudinal axis 27. An inlet connector sleeve 29 is threaded adjacent an inlet end portion of the tubular portion 26 and has a male threaded portion 31 to cooperate with a complementary threaded connector on the end of the hose 12, shown in broken outline. An outlet connector sleeve 33 is similarly threaded on complementary male threads at an outlet end of the tubular portion 26, and has a female threaded portion which receives a male threaded portion 35 of a nozzle inlet portion 37 of the foam generating nozzle 16. The sleeves 29 and 33 cooperate with a water inlet port 30 and a mixture outlet port 34 respectively, the ports 30 and 34 being at opposite ends of the mixing body 15. The connector sleeves 29 and 33, the main tubular portion the foam generating nozzle 16 and related structure are all axially aligned along the axis 27. Thus, it can be seen that portions of the mixing body adjacent the water inlet port 30 and the mixture outlet port 34 have releasable connecting means to releasably connect hollow members thereto, e.g. inlet and outlet sleeves and equivalent members, to discharge therethrough in direction of an arrow 38.

The body 15 has a foam concentrate conduit 40 extending generally transversely from the axis 27 at 90 degrees thereto, although the angle is not critical. The conduit 40 has an inner portion threadedly secured to the main tubular portion 26, and a male threaded outer portion 42 which releasably connects to a complementary threaded sleeve connector at an outer end of the concentrate hose 20, shown in broken outline. The conduit 40 has a concentrate valve 45 comprising a valve ball 47 which is received on a truncated conical valve seat 49 to close a valve orifice 50 at an apex of the seat. The main tubular portion 26 of the body 15 has a foam concentrate inlet port 52 extending into a valve chamber 54 located between the valve seat 49 and the inlet port 52. The port 52 receives foam concentrate from the orifice 50 and the hose 20 as will be described. The ball 47 is free to move within the chamber 54, and is displaced from the seat 49 when foam concentrate flows inwardly through the orifice 50 in direction of an arrow 55 to pass into the port 52. The ball 47 is prevented from blocking the port 52 by a wire spacer means 56 which holds the ball clear of the port 52, so as to prevent blockage of the port 52. However, when fluid in the portion 26 exerts a pressure outwardly in direction of an arrow 58, the ball 47 is forced against the seat 49 and prevents fluid flow outwardly therethrough. Thus it can be seen that the foam concentrate conduit 40 communicates with the concentrate inlet port 52, and the concentrate valve 45 is a one-way check valve to control flow in the concentrate conduit. The valve 45 permits foam concentrate to pass into the body 15, and prevents water from passing outwardly from the body through the valve orifice 50, which effectively also blocks the foam concentrate inlet port 52 against outwards flow of water as will be described.

The foaming apparatus 14 further includes an eductor nozzle disposed within the body and extending between the inlet and outlet ports 30 and 34, which ports receive water from the hose and discharge a water/foam mixture therethrough respectively, as will be described. The eductor nozzle has an eductor inlet portion 64 adjacent and axially aligned with the water inlet port 30, and an eductor outlet portion 62 communicating with the eductor inlet portion 64, along the axis 27 and located to discharge through the outlet port 34. The eductor inlet portion 64 has a relatively short, downstream-converging inlet side wall 70 having upstream and downstream side wall portions 71 and 72 respectively defining relatively large and relatively small openings. The eductor outlet portion 62 has a relatively long, downstream-diverging side wall providing an essentially unobstructed diverging or expanding passage 68, with a downstream rim 66 defining an outlet of the eductor outlet portion which has a net cross-sectional area greater than cross sectional area of an upstream opening of the outlet portion 62, defined by an upstream rim 78. The inlet portion 64 is a relatively short ring retained in place by the sleeve 29, and can be removed if needed, and has a size which is matched to the eductor outlet portion 62 as will be described. The upstream side wall portion 71 merges smoothly with a similarly angled side wall of an inwardly extending rim 74 of the inlet connector sleeve 29. The downstream side wall portion 72 has a short cylindrical section 75 terminating at a downstream rim 76, which defines net area of the inlet port 30.

As best seen in FIG. 2A, the eductor outlet portion 62 has the upstream rim 78 spaced axially downstream from the downstream rim 76 of the inlet portion 64 by an axial manifold spacing 80. Thus, the eductor nozzle is characterized by a converging passage in the inlet portion 64 spaced upstream by the manifold spacing 80 from a diverging passage in the outlet portion 62. The manifold spacing 80 provides an eductor suction port which is disposed between the eductor inlet portion and the eductor outlet portion, and when water flows through the eductor nozzle, low pressure or suction is generated adjacent the spacing 80 to induct foam concentrate into the portion 62 as will be described. The upstream rim 78 of the eductor outlet portion 62 has an internal diameter 82, and the downstream rim 76 of the eductor inlet portion 64 has an internal diameter 84. The diameter 84 is smaller than the diameter 82 and is disposed concentrically therewith. For a discharge nozzle 16 having a nominal delivery capacity of 70 U.S. gallons per minute (318 litres per minute), the internal diameter 82 of the outlet portion upstream rim 78 is 0.500 inches (127 mms.), and the internal diameter 84 of the eductor inlet portion downstream rim 76 is 0.450 inches (124 mms.). This provides a difference in diameters of 0.050 inches (2.6 mms.), which results in a radial difference of 0.025 inches (1.3 mms.). This radial difference is relatively critical and also defines radial thickness of the annular spacing 80 between the downstream rim 76 and the upstream rim 78. The foam concentrate is usually mixed at a concentration ratio of about 1:100 of concentrate:water. This ratio is determined by various factors, but particularly by size of the valve orifice 50 which can be about 0.0781 inches (1.984 mm) in diameter and the above radial difference above between the eductor inlet and outlet portion, i.e. 0.025 inches (1.3 mm). The spacing or suction port 80 has an axial width of about 0.150 inches (7.8 mms) although this is not critical.

The mixing body 15 is hollow, and has a continuously extending, non-perforated, inner side wall 86 having a generally central annular portion provided with a female screw thread 88. The eductor outlet portion 62 has an outer side wall 90 spaced from an upstream portion of the inner side wall 86 of the body to define an annular manifold chamber 92 extending around a portion of the eductor nozzle. A central portion of the outer side wall 90 of the portion 62 has a male screw thread which can engage the female screw thread 88 of the mixing body, so as to permit insertion and removal of the eductor outlet portion 62 as required. The annular manifold chamber 92 communicates with the foam concentrate inlet port 52 and the manifold spacing 80, and thus comprises a portion of a delivery manifold means for communicating the foam concentrate inlet port with the eductor suction port. While the concentrate port 52 is located on one side only of the eductor nozzle, because the manifold chamber 92 extends peripherally completely around the eductor suction port or manifold spacing 80, foam concentrate can pass completely around and surround the upstream rim 78 and thus is drawn into the eductor outlet portion from all positions therearound. Thus, the manifold chamber 92 serves as the manifold means to provide a generally uniform distribution of foam concentrate into the eductor suction port and thus into the nozzle itself to discharge therethrough as will be described.

Engaging means 94 are provided adjacent the downstream rim 66 to permit rotation of the eductor nozzle for insertion and removal as required. Thus, it can be seen that the male screw thread and the complementary female thread 88 serve as releasable connecting means to releasably connect the eductor outlet portion 62 to the body 5 so that the eductor outlet portion is removable from the body as required. It is added that the removable inlet and outlet portions 64 and 62 are for manufacturing convenience only, and it is not anticipated that the eductor inlet and outlet portions will be changed by users in the field. To suit customer requirements, matched eductor portions nozzles having different sized passages can be shop installed within the body 15 for determining flow rating of the apparatus 14 as will be described.

The foam generating nozzle 16 serves as an air entrainment nozzle and, in some instances, resembles portions of prior art air entrainment foaming nozzles. For example, the nozzle 16 has a nozzle body 100 with the nozzle inlet portion 37 having the male threaded portion 35 releasably connected to sleeve 33 which in turn is connected to the mixing body 15 adjacent the outlet port 34 thereof for receiving the mixture. The nozzle has a nozzle outlet portion 105 to discharge the foamed water as will be described, the portion 105 having an internal diameter 106. The nozzle body also has an intermediate portion 107 disposed between the nozzle inlet and outlet portions 37 and 105, which serves as a transition between the relatively small inlet portion 37, and the relatively larger outlet portion 105. Thus, the intermediate portion has a truncated conical side wall to provide the transition,the side wall having a plurality of air entrainment openings 109 disposed therearound to entrain air into the mixture passing through the nozzle.

The nozzle 16 also includes an agitator means 111 for agitating the mixture to produce the foamed water, the agitator means being in accordance with a portion of the present invention and having an agitator jet orifice 110 located generally adjacent the air entrainment openings in the intermediate portion 107. As will be described, the agitator means has a disk-like agitator body 112 which has a circular periphery 115 and is located against a complementary annular shoulder 113 extending around the nozzle inlet portion 37, and is located immediately upstream of the air entrainment openings 109.

Figure 3:
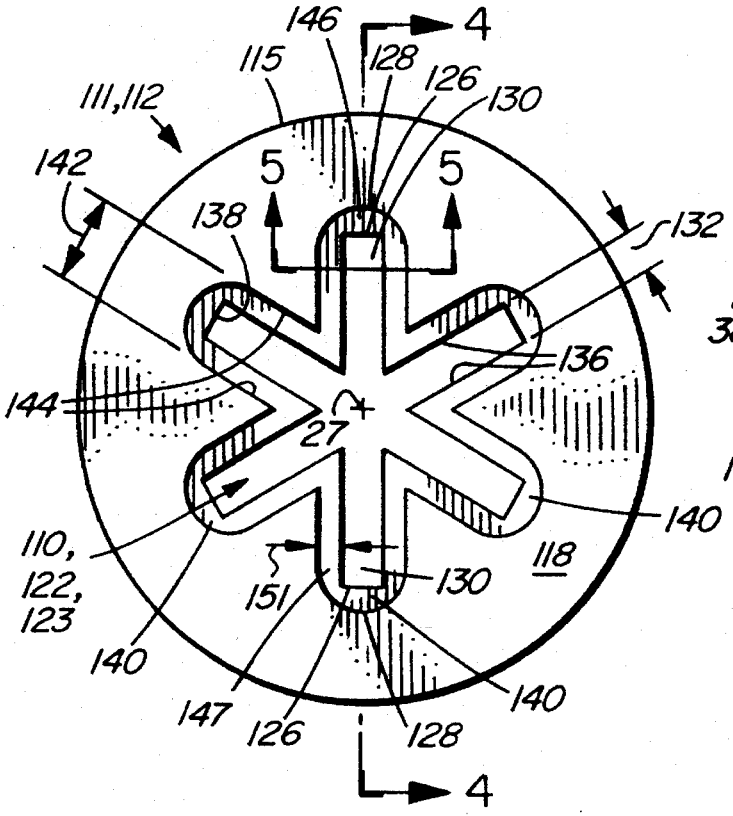
FIG. 3 is a rear elevation of a downstream side of a foaming orifice of the invention.
Figure 4:
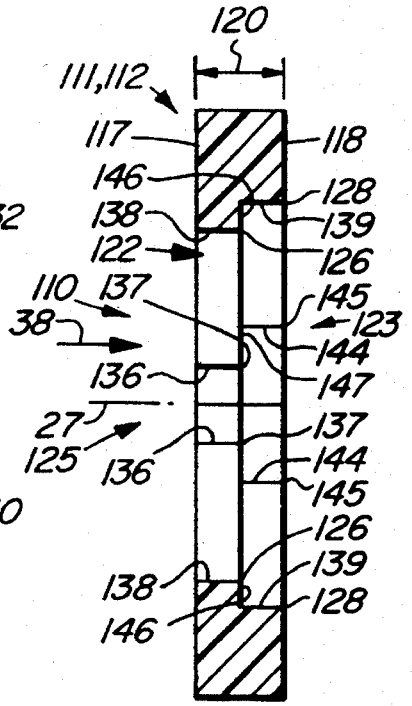
FIG. 4 is a simplified section on line 4—4 of FIG. 3.
Figure 5:
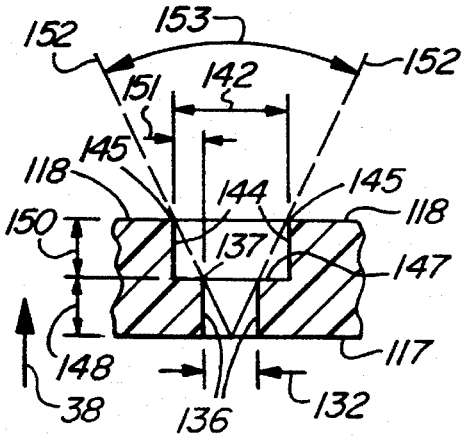
FIG. 5 is a simplified fragmented section on line 5—5 of FIG. 3.

FIGS. 3, 4 and 5

As best seen in FIG. 4, the body 112 of the agitator means 111 has a front or upstream face 117 and a rear or downstream face 118, and axial distance between the faces defines thickness 120 of the agitator means. The faces 117 and 118 have an inlet jet opening 122 and an outlet jet opening 123 respectively, which are disposed symmetrically about the longitudinal axis 27 passing through the centre of the agitator jet orifice 110, the axis 27 also serving as a jet axis. The body 112 is integral, ie is in one piece for manufacturing convenience and maintaining registration, and the terms upstream, downstream, inlet, and outlet refer to general direction of flow through the agitator jet orifice in direction of the arrow 38. The outlet jet opening is larger than the inlet jet opening and communicates with the inlet jet opening to define a single diverging passage 125 of the orifice 110 having a pair of generally similar, oppositely facing, first steps 126 which have sharp edges and are located on opposite sides of the orifice as best seen in FIG. 4. In addition, portions of the rear face 118 adjacent the outlet jet opening provide a pair of generally similar, oppositely facing, second steps 128 which are spaced further apart than the first steps 126, thus further defining portions of the diverging passage 125 through the orifice 110.

As best seen in FIG. 3, the inlet jet opening 122 has a plurality of generally similar elongated inlet slits 130 extending radially outwardly from the jet or nozzle axis 27 and disposed to define a symmetrical six-pointed star-shaped pattern. The inlet slits each have a width 132 defined by space between oppositely facing inlet slit side walls 136, two only being designated in FIG. 3 and shown in FIG. 5. Preferably, the inlet slit side walls 136 are parallel to each other and disposed symmetrically on opposite sides of a radius, not shown, extending from the axis 27, and have outer ends interconnected by a straight slit end wall 138. Also, the outlet jet opening 123 has a plurality of generally similar elongated outlet slits 140 extending radially outwardly from the jet or nozzle axis 27, the outlet slits having a width 142 defined by a space between oppositely facing outlet slit side walls 144, two only being designated in FIG. 3 and shown in FIG. 5. The side walls 144 of each slit are interconnected at outer ends by a curved outlet slit end wall 139. While the inlet slit end walls 138 are straight and the outlet slit end walls 139 are smoothly curved, this is not critical, and is for manufacturing convenience and only slightly changes geometry of the steps. One of the prime purposes of the jet orifice 110 is to provide a relatively long length of sharp or abrupt step edges for a given overall cross-sectional area of the orifice 110. As can be seen in FIG. 3, the length of step edges provided by the sets of slit end walls of the orifice 110 is considerably less than the length of step edges provided by the slit side walls, but all step edges contribute to the overall purpose of agitating the mixture as it passes through the jet orifice.

Referring to FIG. 4, portions of the slit end walls 138 and 139 are generally parallel to the axis 27. A transverse portion 146 extends between the inlet slit end wall 138 and the outlet slit end wall 139 so as to provide a "tread" portion of the first step 126, the tread portion being disposed normally to the axis 27. As best seen in FIG. 5, the inlet slit side walls 136 and the outlet slit side walls 144 are generally parallel to each other and parallel to the axis 27. Also a transverse portion 147 extends between adjacent inlet slit side walls 136 and outlet slit side walls 144 to define the first step 137 and is also a "tread" portion disposed normally to the axis 27. The outlet slit side walls 144 intersect the downstream face 118 to define relatively sharp edges of second steps 145. The transverse portions 146 and 147 are generally coplanar and extend around the periphery of the orifice, and are also in a plane parallel to the upstream and downstream faces 117 and 118, and disposed at a mid-point between the plane. Consequently, the inlet slit side walls 136 and the outlet slit side walls 144 have respective axial depths and 150 which are equal to each other and equal to one-half of the width 120, and equal to undesignated axial depths of the slit end walls. The transverse portion 147 has a width 151 which is of a similar order of magnitude as the axial depths 148 and 150 although this is not critical and can vary with different orifice sizes. The transverse portion 146 adjacent the end walls of the slits has a variable width due to the curved outlet slit end wall 139 and has a maximum width equal to the width 151, but this is generally unimportant.

Referring to FIG. 5, the width 142 of the outlet slit is preferably about twice the width 132 of the inlet slit, which provides a theoretical angle of divergence of flow through the orifice 110 as follows. A pair of inclined broken lines 152 interconnect edges of the first and second steps 137 and 145 on opposite sides of a pair of slits, and an angle 153 is subtended by the lines 152 as shown. The angle 153 is dependent on relative sizes of the dimensions 148, 150 and 151 and can vary between about 45 and 90 degrees. Selection of the angle is also dependent to some extent on the diameter 106 of the nozzle outlet portion 105. Thus, the single diverging stepped passage 125 through the agitator jet orifice is in fact a plurality of interconnected diverging elongated passages arranged as a six-pointed star, each passage extending downstream and outwardly from the orifice into the nozzle body as will be described.

The axial and transverse portions of all the steps intersect at a right angle of 90 degrees to define an edge of the respective step. Clearly, all the slit side walls and slit end walls are generally parallel to the jet axis, whereas the transverse portions, both on the side walls and end walls, are generally normal to the jet axis. The edges of the steps should be relatively sharp, although the actual angle between adjacent side walls and transverse portions is less critical, but should be within a range of between about 70 degrees and 90 degrees. It can be seen that the relatively short step edges of the first step 126 (defined by intersection of the inlet slit end walls 138 and the transverse portions 146), and the relatively long step edges of the first step 137 (defined by intersection of the inlet slit side walls 136 and the transverse portion 147) together define a first step means located between the inlet and outlet jet openings. Similarly, the step edges of the second steps 128 and 145 defined by intersections of the outlet slit end walls 139 and the agitator body 112 together define second step means.

Clearly, referring to FIG. 4, a pair of lines, not shown but equivalent to the lines 152 of FIG. 5, which would interconnect the first and second steps 126 and 128 respectively adjacent the end walls of the slits would be at an angle greater than the angle 153 of FIG. 5, but this also is not critical.

Dimensional and Operating Parameters

Certain aspects of the invention have critical dimensions, and the dimensions are dependent upon operating parameters of water flowing through the nozzle, e.g. primarily volume flow.

The following description refers to a specific example which has been tested and found to produce a foam that is of at least equivalent quality to other commercial foam generating attachments and has been used to extinguish fires of Class A and Class B standards, as specified by the U.S. Underwriters Laboratories. For a nozzle 16 having a discharge flow of 70 U.S. gallons per minute (318 litres per minute) the diameter 82 of the eductor upstream rim is as described previously, namely 0,500 inches (127 mms) and receives water from an downstream rim 76 having a diameter 84, namely 0.450 inches (114 mms). The inlet connector sleeve 29 has a bore of 1,450 inches (368 mms) to receive a standard coupling of a nominal 1.5 inches hose pipe. Such a hose pipe is normally operated pressures of between about 60 and 120 PSI (413 and 827 kPa).

The agitator jet orifice 110 has a net cross-sectional area determined by dimensions of the eductor nozzle, and is based on minimum size of the orifice opening, i.e. size of the inlet jet opening 122 which has a total cross-sectional area of 0.306 sq. inches (197 sq. mms.), which is the sum of six (6) radial inlet slits. Each diametrical pair of inlet slits has an overall diametrical length measured between the end walls of about 0.850 inches (215 mms) and an inlet slit width of about 0,125 inches (3.17 mms). The outlet jet opening 123 has a total area of 0.759 sq. inches (489 sq. mms) and each diametrical pair of outlet slits has an overall diametrical length measured between the curved end walls of about 1.192 inches (30.2 mms) and an outlet slit width of about 0,250 inches (6.3 mms). The transverse portion 147 of the first step 137 of the side walls has a width of 0.063 inches (1.6 mms) and the axial depths 148 and 150 of the side walls are both 0.125 inches (3.17 mms).

The foam generating nozzle 16 has an internal diameter 106 of 2.050 inches (52.07 mms) and an axial length of about 20 inches (50.8 mms) following conventional practice. Also, following conventional practice, the total area of air entrainment openings 109 equals approximately one-half of the cross-sectional area of the discharge nozzle outlet portion 105. Thus, for a discharge nozzle having a cross-sectional area of 3.300 sq. in. (21.29 sq. mms), the total area of air entrainment openings equals 1.570 sq. in. (1012.9 sq. mms). Thus, for eight openings as shown, each opening has a diameter of 0.500 inches (12.7 mms).

Optimum performance for foam generation and water flow is determined by the cross-sectional area of the agitator jet orifice 110, and maximum volume flow rate through the eductor nozzle 62. For the above jet orifice area of 0.306 sq. inches (197 sq. mms), the maximum volume flow through the eductor nozzle is 60 U.S. gallons per minute (270 litres per minute) which generates a suction at the spacing 80 of about 26 inches (630 mm) of mercury. If the flow rate through the eductor nozzle is increased beyond the maximum, the eductor nozzle will "choke". Consequently, even though the nozzle 16 is rated at 70 U.S. gallons per minute, it is preferable to operate the eductor at less than that, e.g. about 60 U.S. gallons per minute, to avoid choking of the nozzle. When the nozzle chokes, pressure in the eductor nozzle will be excessive and will cause water to "back-up" into the valve chamber 54, thus forcing the ball 47 against the seat and closing the concentrate valve 45 thus preventing water from passing into the concentrate container and diluting the concentrate. Clearly, closing the valve 45 cuts off supply of concentrate and prevents further generation of foam which is immediately visible to the operator, who could then make adjustments to reduce inlet flow and pressure to re-establish foam generation. Steadily reducing the flow rate from the maximum rate of flow of the nozzle, reduces "throw" of the nozzle to a condition where there is insufficient suction at the spacing 80 to draw foam concentrate into the stream. If there is insufficient suction, a smaller eductor nozzle and corresponding inlet nozzle ring 69 should be substituted, thus reducing rating of the nozzle.

Operation

The mixing body 15 and associated inlet connector sleeve 29 and outlet connector sleeve 33 can be used at different locations on a standard fire hose, e.g. at the beginning of the hose generally adjacent the water source, at a mid-point on the hose, or at an outer end of the hose adjacent the nozzle as illustrated in FIG. 2. In general, most of the advantages of the invention are obtained by locating the mixing body 15 and sleeves in combination with the foam generator nozzle 16 at the outer end of the hose and the following description assumes this is the location. Clearly, if the mixing body 15 and sleeves 29 and 33 are located at any other position other than the outer end of the hose, the foam generating nozzle 16, complete with the agitator means 111, is connected to the outer end of the hose, and generates foam in a normal manner. The hose can be used in the normal manner to deliver water, and can be quickly adapted to deliver foam as follows. The male threaded portion 31 of the inlet connector sleeve 29 is threaded into a complementary female coupling, not shown, on the end of the hose 12. Usually, the foam fire fighting apparatus 13 is supplied completely assembled with all the components as shown in FIG. 2. A fire fighter merely has to ensure that the foam concentrate container 18 has sufficient foam concentrate, and to connect the concentrate hose 20 to the foam concentrate conduit 40 using a threaded coupling to engage the male threaded portion 42. Water is supplied at sufficient delivery pressure and flow rate as determined by the size of the eductor nozzle and agitator orifice, passes into the water inlet port 30, and is discharged as a generally parallel sided column of water or jet past the downstream rim 76 and into the eductor inlet portion 64. The moving column of water passes across the manifold spacing 80 at a pressure sufficient to generate suction in the annular chamber 92 which serves as a portion of the delivery manifold means.

As described with reference to FIG. 2A, there is a relatively small difference in size between the upstream rim internal diameter 82 of the eductor outlet portion 62, and the downstream rim internal diameter 84 of the eductor inlet portion 64. The difference in diameters and the suction generated by the column of water passing the spacing 80 entrains a thin layer or film of foam concentrate around the outside of the column of water entering the eductor outlet portion 62. This thin layer of foam concentrate encloses the column of water and is drawn along the side wall of the diverging passage 68 and starts to be mixed immediately in the column of water. A quick start of mixing is essential for effective operation of the invention as there is very little mixing length between the manifold spacing 80 and the agitator means 111. Consequently, it is essential that thorough mixing is initiated in this short section, which contrasts with the prior art devices known to the inventor. It is anticipated that severe agitation of the foam concentrate and the water occurs as the column of water leaves the eductor outlet portion 62 into an expanded chamber portion adjacent the outlet port 34, prior to passing through the jet orifice 110 of the agitator means 111. The jet orifices has a cross sectional area which is much smaller than other openings through which water passes, and thus causes a temporary constriction and severe turbulence in flow passing through the agitator jet orifice 110.

The effectiveness of the foaming method of the present invention is attributed to the severe turbulence being generated in the water/foam concentrate mixture as it passes through the agitator means, in particular, as it passes over the edges of the first steps 126 and 137 provided between the inlet and outlet jet openings 122 and 123, and then the second steps 128 and 145 against the downstream face 118. It is assumed that a phenomenon associated with fluid dynamics, termed the "Coanda effect", augments agitation as the column of the water/foam concentrate mixture commences to "expand" upon entering the diverging passage 125 and passing through the inlet slit opening where it is drawn first around the first step 126 and 137, and then into the outlet slit where the mixture passes around the second steps 128 and 145, immediately prior to being exposed to air passing through the air entrainment openings 109.

It can be seen from FIG. 3 that the six radially aligned pairs of inlet and outlet slits provide a considerable length of sharp edges for a relatively small cross-sectional area of orifice. Thus, it is anticipated that a large portion of the relatively small cross-sectional area of mixture passing through the agitator means is subjected to passing sequentially over the two sharp edges of steps, which thoroughly agitates the mixture in a very short length. Immediately after the agitation, large volumes of air are supplied to assist in generating foam, which can then expand into the relatively large nozzle outlet portion 105. The highly agitated foam is discharged from the nozzle outlet portion over "throw" distances of approximately 90 feet (27.5 metres) for a delivery pressure of 70 PSI (490 kPa) and a flow rate of 70 U.S. gallons per minute (265 litres per minute).

Thus, in summary, it can be seen that the foam generation method of the invention is characterized by admitting foam concentrate into a flow of water to form a foam/water mixture and passing the mixture through a relatively small jet opening and across at least one first step edge into a relatively large jet opening to agitate the mixture, followed by entraining air into the agitated mixture to generate the fire fighting foam. Preferably, the mixture is passed across a plurality of step edges between the inlet and outlet jet openings to provide a long length of edges around a relatively small opening. Also after passing the mixture over the first step edges, the mixture is preferably passed over second step edges prior to entraining air therein. Because a circular opening has a minimum circumference for a given cross-sectional area of opening, to provide a step edge which is relatively long compared with the cross-sectional area of the inlet opening, the inlet and outlet jet openings are non-circular. As a minimum, the inlet jet opening could be an elongated inlet slit, and the outlet jet opening could be an elongated outlet slit, with the inlet and outlet jet openings being aligned to define at least one step located between at least one inlet side wall and one outlet side wall adjacent one side of the slit. As in all the arrangements described, the inlet slit side walls and the outlet slit side walls are generally flat and disposed parallel to the jet axis aligned with the flow direction to provide an aligned pair of parallel-sided laterally elongated passages or slits separated by a laterally elongated step edge. It can be seen that, as the flow passes from the inlet jet opening to the outlet jet opening, the flow passes over or across the first step edge which causes portions of the flow to move laterally outwardly across the step edge to agitate the flow. After passing the flow across the first step edge, the flow is passed through the outlet jet opening and across a second step edge spaced laterally outwardly from the fist step edge to enhance generation of foam. Air is entrained into the flow during or after passing the flow across the step edges. Also, preferably the foam concentrate is admitted into the mixture by enclosing a moving column of water with a thin film of foam concentrate to form the mixture.

Thus, it can be seen that the agitator means comprises an inlet jet opening and an outlet jet opening, the outlet jet opening being larger than the inlet jet opening and communicating with the inlet jet opening to provide at least one aligned pair of openings in communication with each other to define a diverging passage. The step means is located between the inlet and outlet jet openings, and flow through the agitator jet opening passes across the step means to agitate the flow to enhance foaming.

Alternatives

The eductor nozzle of the present invention is shown with axially aligned convergent and divergent passages in the inlet and outlet portions 64 and 62 respectively. Adjacent and oppositely facing rims of the inlet and outlet portions are spaced axially apart by a manifold spacing or eductor suction port 80 which is located at the minimum cross-section of the two passages. The nozzle portions could have alternative non-tapered passages in the inlet and outlet portions, that is the inlet and outlet portions could have cylindrical passages, but in this alternative the passage of the inlet portion would be slightly smaller than the passage in the outlet portion to provide space for a thin film of concentrate to form around the column of water, as previously described. Also, sizes of nozzles will vary depending on the particular requirements, one example having been shown for a fire fighting foam generating nozzle having a nominal flow of 70 U.S. gallons per minute, for use with an eductor nozzle having a flow of 60 U.S. gallons per minute.

Smaller size nozzles can be used, for example, for a nozzle having a nominal discharge flow of 30 U.S. gallons per minute (113 litres per minute), the eductor upstream rim internal diameter 82 would be 0.305 inches (7.7 mm) and the inlet portion downstream rim 76 would have a diameter 84 of 0.255 inches (6.5 mm). The agitator jet orifice 110 would have a total cross-sectional area of 0.11 sq. inches (70.9 sq. mm). For this size of nozzle, the six radial inlet slits of FIG. 3 are reduced to four radial inlet slits which are disposed at ninety degrees to each other, i.e. from a six-pointed star to a four-pointed star. In the alternative agitator orifice, each diametrical pair of inlet slits has an overall diametrical length measured between the end walls of about 0.500 inches (1.27 mm), and have an inlet slit width of 0.125 inches (3.2 mm). The outlet jet opening 123 has a total cross-sectional area of 0.222 sq. inches (143 sq. mm). Each diametrical pair of outlet slits has a diametrical length measured between the curved end walls of about 0.625 inches (15.87 mm) with an outlet slit width of 0.25 inches (6.3 mm). The transverse portion 147 of the first step 137 of the side walls has a width of 0.062 inches (1.57 mm). The alternative foam generating nozzle 16 for 30 U.S. gallons per minute has an internal diameter 106 of 1.500 inches (38.1 mm) and an axial length of about 14.5 inches (368.3 mm). This discharge nozzle has a cross-sectional area of 1.767 sq. inches (1140 sq mm) and the 8 air entrainment openings would each have a diameter of 0.375 inches (9.5 mm). For the above jet orifice area of 0.110 sq inches (70.9 sq mm), the maximum volume flow through the eductor nozzle is 20 U.S. gallons per minute (76 litres per minute).

Clearly, other sizes and shapes of jet orifices and appropriate eductor nozzle diameters and discharge nozzles diameters can be devised by simple experiment. For manufacturing convenience, it has been found appropriate to provide a complementary recess adjacent the shoulder 113 in the nozzle inlet portion 37 to receive the agitator body 112 having the appropriately sized agitator orifice, with the body 112 having a constant thickness, irrespective of size of the orifice opening. Consequently, as the orifice opening becomes smaller to match smaller flow rates through the nozzle, the angle 153 of FIG. 4 becomes correspondingly smaller.

The two examples of dimensions described above relate to fire fighting nozzles for attachment to a conventional fire fighting hose pipe of a nominal 1.5 inches (38 mms) bore. Advantages of the invention can also be obtained for use with much smaller sized hose pipes, for example domestic garden hoses having nominal bores of about 0.5 inches (12.7 mms). A nozzle of the present invention for use with such pipes would be rated at approximately 3 U.S. gallons per minute (11.3 litres per minute) and would require a correspondingly much smaller eductor nozzle and agitator jet orifice. For manufacturing convenience, due to the relatively small size of the components, the eductor inlet and outlet portions could have cylindrical passages, that is non-tapered passages, and the agitator jet orifice would preferably have no more than four radial inlet slits to form a four-pointed star. The agitator jet orifice 110 would have a total cross-sectional area of 0.175 sq inches (11.29 sq mms). Each diametrical pair of inlet slits would have an overall diametrical length measured between the end walls of about 0.200 inches (15.08 mms), with an inlet slit width of 0.050 inches (1.27 mms). The outlet jet opening would have a total cross-sectional area of 0.050 square inches (32.26 square mms). Each diametrical pair of outlet slits would have a diametrical length measured between the curved end walls of about 0.300 inches (7.62 mms) with an outlet slit width of 0.100 inches (2.54 mms). The transverse portion 147 of the first step 137 of the side walls would have a width of 0.050 inches (1.27 mms), and the axial depth 148 and 150 of the side walls would be about 0.100 inches (2.54 mms). Residential garden hoses can operate at water pressures of between about 30 and 60 PSI (207 and 414 kPa), and clearly could have applications for spraying foaming garden or household chemicals as well as fire-fighting foam.

Figure 6:
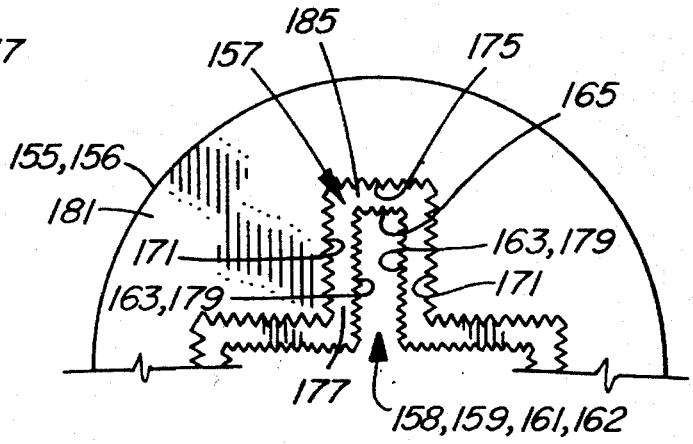
FIG. 6 is a rear elevation of a downstream side of an alternative foaming orifice.

As stated previously, it is believed that the effectiveness of the foam generation aspect of the present invention is dependent upon providing a relatively long length of step edges for a given cross-sectional area of agitator orifice opening. While the agitator means of FIGS. 3, 4 and 5 is shown having six radial pairs of inlet and outlet slits extending from the axis, clearly shape of the orifice can be changed depending on the size or diameter of the body of the agitator means. Alternatively, in addition, the edges of the steps can be provided with a "saw-tooth" profile so as to increase considerably overall length of step edge for a given size of inlet and outlet slits. This is shown in FIG. 6.

FIG. 6

An alternative agitator means 155 has a disk-like agitator body 156 and an agitator jet orifice 157 having four pairs of inlet and outlet jet openings 158 and 159 respectively. One complete pair of an elongated inlet slit 161 and aligned elongated outlet slit 162 is shown, with undesignated portions of similar pairs of slits being shown on one side only of a diameter of the body. While the number of pairs of inlet and outlet jet openings could be varied, and could be six as shown in the agitator means or eight or more, depending on the size, the major difference between the two agitator means 111 and 155 relates to the shape of the slit side walls as follows.

The elongated inlet slit 161 of the inlet jet opening 158 has a pair of oppositely facing inlet slit side wall 163 which are provided with a plurality of small serrations resembling saw teeth. An inlet slit end wall 165 disposed perpendicularly to the inlet slit side walls 163 is similarly provided with serrations. Similarly, the outlet slit 162 of the outlet jet opening 159 has a generally parallel pair of elongated outlet slit side walls 171 which are also provided with a plurality of fine serrations as shown. Similarly, the outlet slit 162 has an outlet slit end wall 175 disposed perpendicularly to the slit side walls 171 and is similarly provided with serrations. The serrations are disposed generally parallel to the axis 27, and extend the full depth of the respective slit side walls. A flat transverse portion 177 extends between the inlet slit side walls and outlet slit side walls and normally to the jet axis, not shown, to provide the inlet slit side walls with a first step edge 179. Clearly, the step edge will be similarly serrated, which will increase considerably the effective length of the step edge compared with a straight step edge. It is anticipated that the effective length of the step edge is probably doubled or tripled by the serrations, depending on the pitch and depth of the serrations. Similarly, a rear or downstream face 181 of the alternative agitator means 155 intersects the outlet slit side walls 171 to provide second steps 183, which are similarly serrated with a corresponding increase in length over a straight side wall. A corresponding transverse portion 185 extending between the slit end walls 165 and 175, and the face 181 also provide first and second serrated step edges adjacent ends of the slits. It can be seen that at least one side wall of the alternative has a plurality of serrations or teeth extending therealong to increase overall length of the step edge associated with the said side wall to enhance agitation of water flowing through the alternative agitator means. The transverse portions 177 and 185 are coplanar and disposed mid-way between front and rear faces of the agitator body 156.

Other means of increasing effective length of the step means can be devised, e.g. third and if necessary fourth steps can be provided expanding downstream in a manner similar to the first and second steps as shown, which would in general require a greater thickness of agitator means. In any event, the last step of the agitator should be positioned closely adjacent and upstream of the air entrainment openings, so as to obtain maximum benefit of aeration occurring immediately after the agitator orifice.

The agitator means is shown in use with a eductor nozzle and an air entrainment nozzle, particularly to generate fire fighting foam. Existing equipment is available which admits an accurate ratio of foam concentrate into a pressurized flow of water, which then passes along a hose pipe to a foaming nozzle having a jet orifice, and air entrainment openings. Clearly, the agitator body using the jet orifice of the present invention could be substituted for the jet orifice in existing fire fighting nozzles to provide the advantages of the present invention without requiring use of the specific eductor and other structure as described herein.

The description above describes use of the invention to generate fire fighting foam. Other uses are envisaged wherein a foam concentrate for other applications, e.g. herbicide or insecticide spray in foam form, are envisaged. This would likely require lower rates of flow and delivery pressures, which could be accommodated by scaling down the invention, whilst still obtaining benefits of foam generation-in a relatively short space of mixing body and nozzle combination as described.

We claim:

1. An agitator apparatus for generating foam from a flow of pressurized water and foam concentrate, the agitator apparatus having an agitator body comprising:

(a) an agitator jet orifice comprising an inlet jet opening in an upstream face of the body and an outlet jet opening in a downstream face of the body, the openings being disposed in series, the outlet jet opening being larger than the inlet jet opening and communicating with the inlet jet opening to define a diverging passage extending through the agitator body; and (b) a first step means having a relatively abrupt step edge located between the inlet and outlet jet openings, so that flow through the agitator jet orifice passes across the first step means to agitate the flow to enhance mixing and generation of foam.

2. An apparatus as claimed in claim 1, in which:

(a) the step edge is relatively long when compared with cross-sectional area of the inlet jet opening.

3. An apparatus as claimed in claim 1, in which:

(a) the inlet jet opening is an elongated inlet slit having a width defined by space between oppositely facing inlet slit side walls, (b) the outlet jet opening is an elongated outlet slit having a width defined by space between outlet slit side walls, the width of the outlet jet opening being greater than the width of the inlet jet opening, and (c) the inlet and outlet jet openings are aligned about a jet axis to define at least one step located between at least one inlet slit side wall and one outlet slit side wall adjacent one side of the slit, the step having an abrupt step edge to enhance agitation.

4. An apparatus as claimed in claim 3, in which:

(a) the agitator body has upstream and downstream faces, and axial distance between the faces defines thickness of the body, (b) the outlet slit side walls intersect the downstream face of the agitator body to provide second steps having an abrupt edge to enhance agitation.

5. An apparatus as claimed in claim 3, in which:

(a) at least one side wall of the inlet slit side wall or outlet slit side wall has a plurality of teeth extending thereal-long to increase overall length of the step edge associated with said side wall to enhance mixing and generation of foam.

6. An apparatus as claimed in claim 1, in which:

(a) the inlet and outlet jet openings are non-circular, and (b) the first step means has a step edge which is relatively long when compared with cross-sectional area of the inlet jet opening.

7. An apparatus as claimed in claim 6, in which:

(a) the inlet slit side walls and the outlet slit side walls are generally flat and disposed parallel to a jet axis aligned with flow direction to provide an aligned pair of parallel sided laterally elongated passages separated by a laterally elongated step edge.

8. An apparatus as claimed in claim 1 in which:

(a) the agitator jet orifice comprises a plurality of interconnected elongated passages extending downstream and outwardly away from each other to define a multi-pointed star.

9. An apparatus as claimed in claim 1 in which:

(a) the jet openings are aligned about a jet axis passing through the orifice;

(b) the inlet jet opening has at least one elongated inlet slit extending outwardly from the jet axis, the inlet slit having a width defined by space between oppositely facing inlet slit side walls;

(c) the outlet opening has at least one elongated outlet slit extending outwardly from the jet axis and being aligned with the inlet jet opening to define a pair of aligned slits, the outlet slit having a width defined by space between outlet slit side walls, the width of the outlet slit of the pair of aligned inlet and outlet slits being greater than the width of the inlet slit of the pair; and (d) the aligned inlet and outlet openings of the said pair have at least one step located between an inlet slit side wall and an outlet slit side wall adjacent one side of the slit.

10. An apparatus as defined in claim 9, in which:

(a) the width of the outlet slit is approximately twice the width of the inlet slit.

11. An apparatus as claimed in claim 1 in which:

(a) the step has an axial portion and a transverse portion meeting at an angle to define an edge of the step, the angle between approximately 70 and 90 degrees.

12. An apparatus as claimed in claim 11, in which:

(a) the agitator body has upstream and downstream faces, and axial distance between the faces defines thickness of the agitator body, (b) the transverse portion of the step is disposed approximately midway between the upstream and downstream faces of the body, so that the inlet slit side wall, which defines the axial portion of the step, has an axial depth generally equal to axial depth of the outlet slit side wall, and (c) the transverse portion of the step has a width which is of a similar order of magnitude as the axial depth of the inlet and outlet slit side walls.

13. An apparatus as claimed in claim 11, in which:

(a) the axial portion is generally parallel to a jet axis passing through the orifice, (b) the transverse portion is generally normal to the jet axis; and (c) the step has a step edge defined by a generally perpendicular intersection between said axial and said transverse portions of the step.

14. An apparatus as claimed in claim 1, further comprising:

(a) an air entrainment nozzle having a nozzle body with a nozzle inlet portion to receive the flow of water and foam concentrate, a nozzle outlet portion to discharge foamed water, and an intermediate portion disposed between the nozzle inlet and nozzle outlet portions, the intermediate portion having at least one air entrainment opening to entrain air into the flow passing through the nozzle to enhance foam generation, and (b) the agitator body is located within the intermediate portion of the nozzle body and upstream of the air entrainment opening.

15. A method of generating foam from a flow of pressurized water and a foam concentrate, the method comprising:

(a) passing the flow through a relatively small inlet jet opening in an upstream face of an agitator body, and across at least one first step edge into a relatively large outlet jet opening in a downstream face of the agitator body, the inlet and outlet jet openings communicating with each other to provide a diverging passage, the step edge being relatively abrupt to augment agitation of the flow.

16. A method as claimed in claim 15 further comprising:

(a) passing the flow across the step edge which is relatively long when compared with cross-sectional area of the inlet jet opening.

17. A method as claimed in claim 15, further comprising:

(a) passing the flow through the relatively small inlet jet opening defined by at least one pair of laterally spaced apart parallel inlet slit side walls, (b) passing the mixture through the relatively larger outlet opening defined by a pair of parallel outlet slit side walls, and (c) as the flow passes from the inlet jet opening to the outlet jet opening, passing the flow over the step edge which causes portions of the flow to move laterally outwardly across the step edge to agitate the flow.

18. A method as claimed in claim 15, further characterized by:

(a) after passing the flow across the first step edge, passing the flow through the outlet jet opening and across a second step edge spaced laterally outwardly from the first step edge to enhance generation of foam.

19. A method as claimed in claim 15, further characterized by:

(a) entraining air into the flow during or after passing the flow across the step edges to generate the foam.

* * * * *